United States Patent [19]

Begley

[11] Patent Number: 4,895,266

[45] Date of Patent: Jan. 23, 1990

[54] TAMPER INDICATING BAND FOR PLASTIC CLOSURE

[75] Inventor: Douglas G. Begley, Palatine, Ill.

[73] Assignee: Continental White Cap, Inc., Norwalk, Conn.

[21] Appl. No.: 275,414

[22] Filed: Nov. 23, 1988

[51] Int. Cl.[4] ..... B65D 41/34

[52] U.S. Cl. ..... 215/230; 215/252

[58] Field of Search ..... 215/252, 230

[56] References Cited

U.S. PATENT DOCUMENTS

| | | | |
|---|---|---|---|
| 2,201,791 | 5/1940 | Samburg | 215/7 |
| 3,737,064 | 6/1973 | Patel | 215/42 |
| 4,126,240 | 11/1978 | Brach | 215/252 |
| 4,147,268 | 4/1979 | Patel | 215/252 |
| 4,478,343 | 10/1984 | Ostrowsky | 215/252 |
| 4,592,475 | 6/1986 | Hannon | 215/252 |

*Primary Examiner*—Donald F. Norton

*Attorney, Agent, or Firm*—Charles E. Brown; Paul Shapiro; Charles A. Brown

[57] ABSTRACT

This relates to a tamper indicating band which is carried by a plastic closure to indicate that the plastic closure has at least in part been unscrewed with respect to an associated container. It is proposed that the tamper indicating band be directly connected to the closure skirt by way of bridges with the bridges having rupturable connections with the skirt and hinge connections with the tamper indicating band. Thus the tamper indicating band may be folded from its as molded state depending from the skirt to a position projecting upwardly into the lower part of the skirt. When the closure is applied to a conventional type of container, the tamper indicating band locks beneath a locking bead on the container neck finish and when the closure is unthreaded, the engagement of the tamper indicating band with the bead will prevent the tamper indicating band to move upwardly with the closure. As a result, the bridges rupture and the tamper indicating band drops down on the closure neck to indicate that there has been tampering. In one form of the closure, the bridges are twisted 90 degrees from their connection with the skirt to their connection with the tamper indicating band to provide positive rupture points and hinge points. Further, the bridges are elongated so that the lower portion of the tamper indicating band and the applied condition of the closure will be readily visible to indicate to a purchaser that the tamper indicating band exists.

12 Claims, 1 Drawing Sheet

TAMPER INDICATING BAND FOR PLASTIC CLOSURE

This invention relates in general to new and useful improvements in plastic closures having tamper indicating means, and more particularly to a plastic closure having a tamper indicating band connected to a skirt thereof in a manner wherein when the closure is initially removed from an associated container, the tamper indicating band will separate from the skirt and drop down on the container neck finish to indicate that the closure has been previously moved towards a removal position.

There are numerous types of tamper indicating bands; most of which are removably connected to a lower edge of a closure skirt by means of rupturable bridges. Normally the tamper indicating bands carry means which engage with a bead on a container neck finish so as to effect the rupture of the tamper indicating band either relative to the closure skirt or in of itself to indicate the fact that the closure has been at least partially unthreaded with respect to its associated container. At the time of applicant's invention, applicant was aware of U.S. Pat. Nos. 4,407,422; 4,458,822; 4,488,655; 4,511,053; 4,511,054; 4,546,892; 4,550,844; 4,572,388; 4,613,052; 4,643,321; 4,653,657; 4,655,356; 4,657,153 and 4,664,279.

The purpose of this invention is to indicate closure removal by dropping a thin ring into view below the closure skirt. Prior to usage, the band, which is a tamper indicating band, can be either hidden inside the cap skirt or positioned partially into view under the skirt to more easily verify that a band is present. Upon opening, all bridges connecting the tamper indicating band to the closure skirt are broken and the tamper indicating band is free to fall to the bottom of the container neck finish.

Universally, tamper evident closures using segmented flaps or continuous incline rings use a tamper band including a band body to which a flap or similar member is joined. The band body is suspended below the closure skirt and depending on design, the user inspects the band body for either a split or an increased or inconsistent gap between the band body and the closure skirt.

In accordance with this invention, the conventional band body is eliminated and the need for the user to make judgements as to its alignment or condition is also eliminated.

Basically, there are two approaches to this invention. In accordance with the first approach, there is molded a continuous inclined flap or ring under the closure skirt and attached to the closure skirt by breakable bridges. This flap or ring is thin and is folded up inside of the closure skirt and hidden by the closure skirt from view. Upon the application of the closure to a container neck finish, the uppermost tip of the ring, which functions as a tamper indicating band, locks under a bead on the container neck finish. When the closure is unscrewed for dispensing of the product of the container, the ring remains below the bead and the bridges break allowing the ring to fall down to the bottom of the neck finish. The sudden visibility of the ring indicates prior cap removal, and this can be enhanced by lettering, such as "opened" molded into the outside of the repositioned ring.

If desired, a vertical line of weakness in the ring can cause the ring to tear if removal from the neck finish is attempted, but in all instances, the ring has no means of support when the closure is reapplied.

In the second approach of this ivention, the bridges are extended and have the ring which forms the tamper indicating band able to fold up at their lower ends. This arrangement keeps part of the ring visible at all times and so allows the user to insure prior to purchase that the security ring or tamper indicating band has not simply been removed. In some cases this approach may be a more desirable in that the purchaser does not have to wait until first use to make sure that a ring appears.

Suspending the ring requires a specially shaped bridge for proper function. The folding point must be at the bottom of the bridges or the ring would be tucked fully into the skirt, and a high mounted breaking point assures that the ring cannot be repositioned to a pre-use appearance by trying to hang the ring on the remanents of broken bridges.

The bridges are specifically configurated to provide a thin flat section at the bottoms of the bridges which will allow the ring to easily pivot in a living hinge action. When joined to the closure skirt, the bridges will have their thin section oriented 90 degrees from the lower end of the bridges so that the bridge will resist any tendency to fold inwardly. At the same time, the bridge must break first so its connecting area must be less than that of the lower end.

With the above and other objects in view that will hereinafter appear, the nature of the invention will be more clearly understood by reference to the following detailed description, the appended claims, and the several views illustrated in the accompanying drawings.

Figure 1:
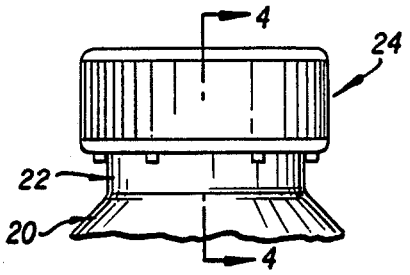
FIG. 1 is an elevational view of a plastic closure formed in accordance with this invention and shown applied to the neck finish of a container.

Referring now to the drawings in detail, it will be seen that there is illustrated a conventional container generally identified by the numeral 10. The container 10 is provided with a neck finish 22 for receiving in threaded engagement a plastic closure in accordance with this invention, the plastic closure being generally identified by the numeral 24.

Figure 5:
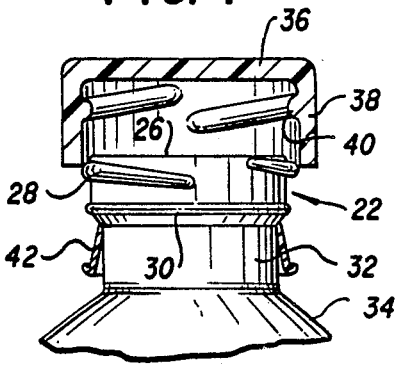
FIG. 5 is a view similar to FIG. 4 and shows the closure in a position of substantially full removal with the tamper indicating band having separated therefrom and dropped down on the neck finish to indicate tampering.

As is best shown in FIG. 5, the neck finish 22 includes an end sealing surface 26, external thread means 28 and a tamper indicating band retaining bead 30. The neck finish 22 also includes a lower neck 32 of a reduced diameter which terminates in the container shoulder 34.

The closure 24 includes a cap portion which is of a conventional construction and which includes an end panel 36 and an integrally molded depending skirt 38. The end panel 36 will either directly or by way of a suitable gasket, form a seal with the end sealing surface 26. The skirt 38 is provided with a internal thread means 40 which cooperate with the thread means 28 so as to permit the closure 24 to be unthreaded from the neck finish 22 and repositioned thereon in sealed relation.

All of the foregoing described elements are conventional and known in the prior art.

Figure 2:
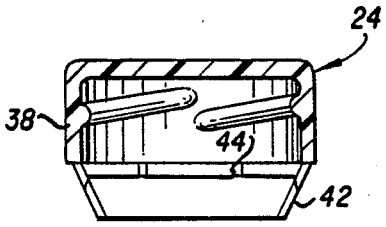
FIG. 2 is a half sectional view through the closure in its as molded state.
Figure 7:
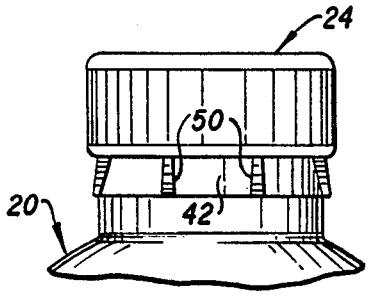
FIG. 7 is an elevational view similar to FIG. 1 wherein the bridges are elongated so as to permit viewing to determine the existence of the ring prior to purchasing.
Figure 3:
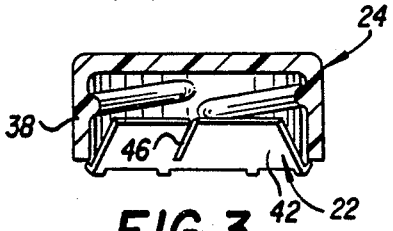
FIG. 3 is another half sectional view of the closure similar to FIG. 2 and shows the ring which forms the tamper indicating band folded to its position of use.

In accordance with this invention, in lieu of the relatively heavy conventional tamper indicating band, the skirt 38 of the closure cap has integrally molded with the lower edge thereof a thin ring or band 42 which is removably connected to the skirt 38 by way of a plurality of circumferentially spaced bridges 44. Either the bridges 44 are rupturable or have a rupturable connection with the skirt 38. On the other hand, the bridges 44 provide for a hinged type connection between the ring 42 and the skirt 38 so that the ring or band 42 may be readily folded from its as molded state of FIG. 2 to a generally upstanding, radially inwardly sloping position as is shown in FIG. 3 ready for application to a container.

Figure 4:
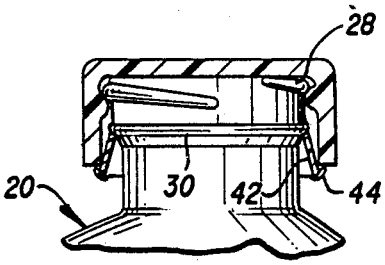
FIG. 4 is a transverse vertical sectional view taken through the closure generally along the line 4—4 of FIG. 1 and shows the closure fully applied to a container neck finish which is shown in elevation.

It is to be understood that when the closure 24 is applied, the ring or band 42 will be formed so as to pass down over first the thread means 28 and then the bead 30 to the position shown in FIG. 4 wherein the ring or band 42 will lock below the bead 30.

When the container 20 is opened by unthreading the closure 24, the band or bead 42 is retained in its original position and after a limited upward movement of the cap on the container neck finish, the bridges 44 will rupture and the band or bead 42 will drop down away from the closure generally on to the shoulder 34 as is best shown in FIG. 5.

Figure 6:
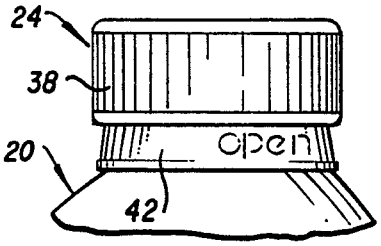
FIG. 6 is an elevational view of the container after the closure has been removed therefrom and then reapplied with the tamper indicating band in its dropped down position and indicating that the container has been previously opened.

Thus, should the closure 24 be reapplied to the original position of the cap, the ring or band 42 having dropped down over the container neck 32 to the position shown in FIG. 6 will be readily apparent from one viewing the containers 20 on the shelf of a store to note that the band 42 has assumed a position where it is clearly obvious that the container has been previously opened. If desired, the band 42 may have molded in the exterior surface thereof indicia, such as the word——OPEN——to more clearly indicate to a would be purchaser that the container has been previously opened.

Referring once again to FIG. 3, it will be seen that the band 42 may be provided with a generally axial weakening line 46 which permits the band 42 to split if required to permit installation thereof over the neck finish 22.

In certain instances, it may be desired that the band 42 be readily visible when the container is on a store shelf. In order to accomplish this, the closure 24, instead of being provided with the short beads 44 as illustrated in FIGS. 1 through 6, may be provided with elongated bridges 50 as is clearly illustrated in FIGS. 7–10. This provides a lower point of hinge connection between the bridges and the band so that a lower portion of the band will be clearly visible.

Figure 8:
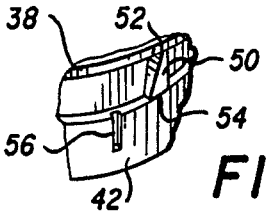
FIG. 8 is a fragmentary schematic prespective view showing the twisted detail of a typical bridge and the mounting of the ring which forms the tamper indicating band.
Figure 9:
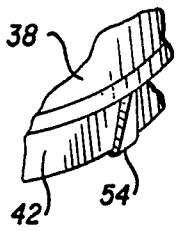
FIG. 9 is a view similar to FIG. 8 and shows the ring in its folded ready for use state.
Figure 10:
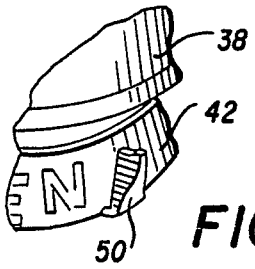
FIG. 10 is another view similar to FIG. 8 and showing the parts of the closure in their separated state.

The bridges 50 are of a special construction as is generally shown in FIGS. 8–10. Each bridge 50 is twisted 90 degrees from its connection as at 52 with the skirt 38 to its connection as at 54 with the band 42. Thus the connections 52 extend radially while the connections 54 extend circumferentially.

The connections 52 are preferably of a rupturable type while the connections 54 are hinge connections. The hinge connections 54 permit the band 42 to be folded from its as molded state of FIG. 8 to its upturned ready for use state of FIG. 9.

Referring now to FIG. 10, it will be seen that after the closure has been applied and then removed, the bridges 50 will remain connected to the band 42 so that the bridges 50 can in no way be utilized to temporarily reconnect the band 42 to the skirt 38.

Further, with respect to FIG. 8, it will be seen that the band 42, starting along that edge thereof to which the bridges 50 are connected, will be provided with a generally axially extending line of weakening 56 which may be utilized to facilitate the removal of the band 42 from the neck finish 22.

At this time it is pointed out that the band 42 in the environment of FIGS. 1 through 6 may be provided with the line of weakening 56 or the band 42 as shown in FIGS. 7–10 may be provided with the line of weakening 46.

Although only two preferred embodiments of the closure and tamper indicating band have been specifically illustrated and described herein, it is to be understood that minor variations may be made in the tamper indicating band and the mounting thereof without departing from the spirit and scope of the invention as defined by the appended claims.

I claim:

1. A tamper indicating band for a plastic closure of the type having a skirt, said tamper indicating band being as molded an integrally connected extension of said skirt and being hingedly connected to said skirt for generally reverse folding to an upstanding radially inwardly sloping in use position for locking engagement beneath a neck finish bead, and circumferentially spaced rupturable bridges releasably connecting said tamper indicating band to said skirt, said rupturable bridges having hinge connections with said tamper indicating band.

2. A tamper indicating band according to claim 1 wherein said bridges have rupturable connections with said skirt.

3. A tamper indicating band according to claim 2 wherein said rupturable connections extend primarily radially and said hinge connections extending primarily circumferentially.

4. A tamper indicating band according to claim 1 wherein said hinge connections extend primarily circumferentially.

5. A tamper indicating band for a plastic closure of the type having a skirt, said tamper indicating band being as molded an integrally connected extension of said skirt and being hingedly connected to said skirt for generally reverse folding to an upstanding radially inwardly sloping in use position for locking engagement beneath a neck finish bead, and spaced rupturable bridges releasably connecting said tamper indicating band to said skirt, said bridges being twisted through an angle on the order of 90 degrees between said skirt and said tamper indicating band.

6. A tamper indicating band for a plastic closure of the type having a skirt, said tamper indicating band being as molded an integrally connected extension of said skirt and being hingedly connected to said skirt for generally reverse folding to an upstanding radially inwardly sloping in use position for locking engagement beneath a neck finish bead, and circumferentially spaced rupturable bridges releasably connecting said tamper indicating band to said skirt, said bridges being of an axial dimension to render a then lower part of said tamper indicating band visible when said closure is applied and is in an unopened position to detect existence of said tamper indicating band.

7. A tamper indicating band for a plastic closure of the type having a skirt, said tamper indicating band being as molded an integrally connected extension of said skirt and being hingedly connected to said skirt for generally reverse folding to an upstanding radially inwardly sloping in use position for locking engagement beneath a neck finish bead, and circumferentially spaced rupturable bridges releasably connecting said tamper indicating band to said skirt, said tamper indicating band in use having tamper indicating indicia visible only when said tamper indicating band has separated from said skirt and dropped down away from said skirt.

8. A tamper indicating band for a plastic closure of the type having a skirt, said tamper indicating band being as molded an integrally connected extension of said skirt and being hingedly connected to said skirt for generally reverse folding to an upstanding radially inwardly sloping in use position for locking engagement beneath a neck finish bead, and circumferentially spaced rupturable bridges releasably connecting said tamper indicating band to said skirt, said tamper indicating band having a generally axial weakening line therein generally at a free edge of said tamper indicating band for permitting limited circumferentially expansion of said tamper indicating band during application.

9. A tamper indicating band for a plastic closure of the type having a skirt, said tamper indicating band being as molded an integrally connected extension of said skirt and being hingedly connected to said skirt for generally reverse folding to an upstanding radially inwardly sloping in use position for locking engagement beneath a neck finish bead, and circumferentially spaced rupturable bridges releasably connecting said tamper indicating band to said skirt, said tamper indicating band having a generally axial weakening line therein adjacent said skirt for facilitating removal of a released tamper indicating band from said skirt.

10. In a plastic closure of the type including a tamper indicating band joined to a closure skirt by bridges, said bridges being of a twisted configuration and having a primarily radial connection with said skirt and a primarily circumferential connection with said tamper indicating band.

11. A closure according to claim 10 wherein said bridges are rupturable adjacent said radial connections.

12. A closure according to claim 10 wherein said circumferential connections are hinge connections.

* * * * *